US005117804A

United States Patent [19]

Jörlöv

[11] Patent Number: 5,117,804

[45] Date of Patent: Jun. 2, 1992

[54] SIGHTING DEVICE FOR USE ON BOWS

[75] Inventor: Richard Jörlöv, Lomma, Sweden

[73] Assignee: AIMPOINT AB, Sweden

[21] Appl. No.: 669,027

[22] Filed: Mar. 13, 1991

[30] Foreign Application Priority Data

Mar. 14, 1990 [SE] Sweden ..... 9000908

[51] Int. Cl.[5] ..... F41B 5/00

[52] U.S. Cl. ..... 124/87; 33/265

[58] Field of Search ..... 124/87, 23.1, 86, 88; 33/265

[56] References Cited

U.S. PATENT DOCUMENTS

| | | | |
|---|---|---|---|
| 2,642,661 | 6/1953 | Fredrickson | 124/87 |
| 4,497,116 | 2/1985 | Hawkins | 124/87 X |
| 4,917,072 | 4/1990 | Chang | 124/87 X |
| 4,967,478 | 11/1990 | Sherman | 124/87 X |

FOREIGN PATENT DOCUMENTS

| | | | |
|---|---|---|---|
| 0907389 | 2/1982 | U.S.S.R. | 124/87 |

*Primary Examiner*—Peter M. Cuomo
*Assistant Examiner*—Jeffrey L. Thompson
*Attorney, Agent, or Firm*—Laurence R. Brown

[57] ABSTRACT

A sighting device for use on bows comprises a sight carrying plate sandwiched between a mounting plate and a friction plate, the two latter plates being non-displaceable relative the bow, said sight carrying plate being governed in its plane relative the two other plates by three studs rigidly connected to the mounting plate, two of said studs extending through an arcuate slot on the sight carrying plate, which the third stud carries a toothed wheel engaging a toothed rack on the sight carrying plate, said toothed rack being arc shaped and having the same center as that of said arcuate slot.

4 Claims, 4 Drawing Sheets

SIGHTING DEVICE FOR USE ON BOWS

This invention relates to a sighting device for use on bows.

It is well known in the art of archery to use sighting devices adjustably mounted on a bow to compensate for various distances to a target. The sight means should follow a line between the eye of the archer and the target and this involves that the sight means should be displaced downwards relative the bow along an imaginary circle having its center at the eye of the archer. In case of a normal size archer the radius of the circle will be about 70 cm.

The present invention has for its object to provide a sighting device which is easy to adjust and which is of a simple and rigid construction making it resistent against deformations and adverse adjustments caused by outer forces.

A sighting device for use on bows comprising a mounting plate adapted to be rigidly connected to a bow, a friction plate located parallel to said mounting plate at varying distances, and a sight carrying plate sandwiched between said mounting plate and said friction plate is according to the present invention characterised in that said mounting plate is provided with three studs extending from one side thereof and forming a triangle thereon; that said sight carrying plate is provided with a slot adapted to receive two of said studs and having a radius between 0.5 and 1 meter; that said sight carrying plate has an arcuate tooth rack at a distance from said arcuate slot and having the same arc center as said slot; and that the third one of said three studs carries a toothed wheel of such size and shape as to engage said toothed rack.

The invention will be described in more detail reference being made to the accompanying drawings in which FIG. 1 is a side view of a mounting plate attached to a bow;

Figure 1:
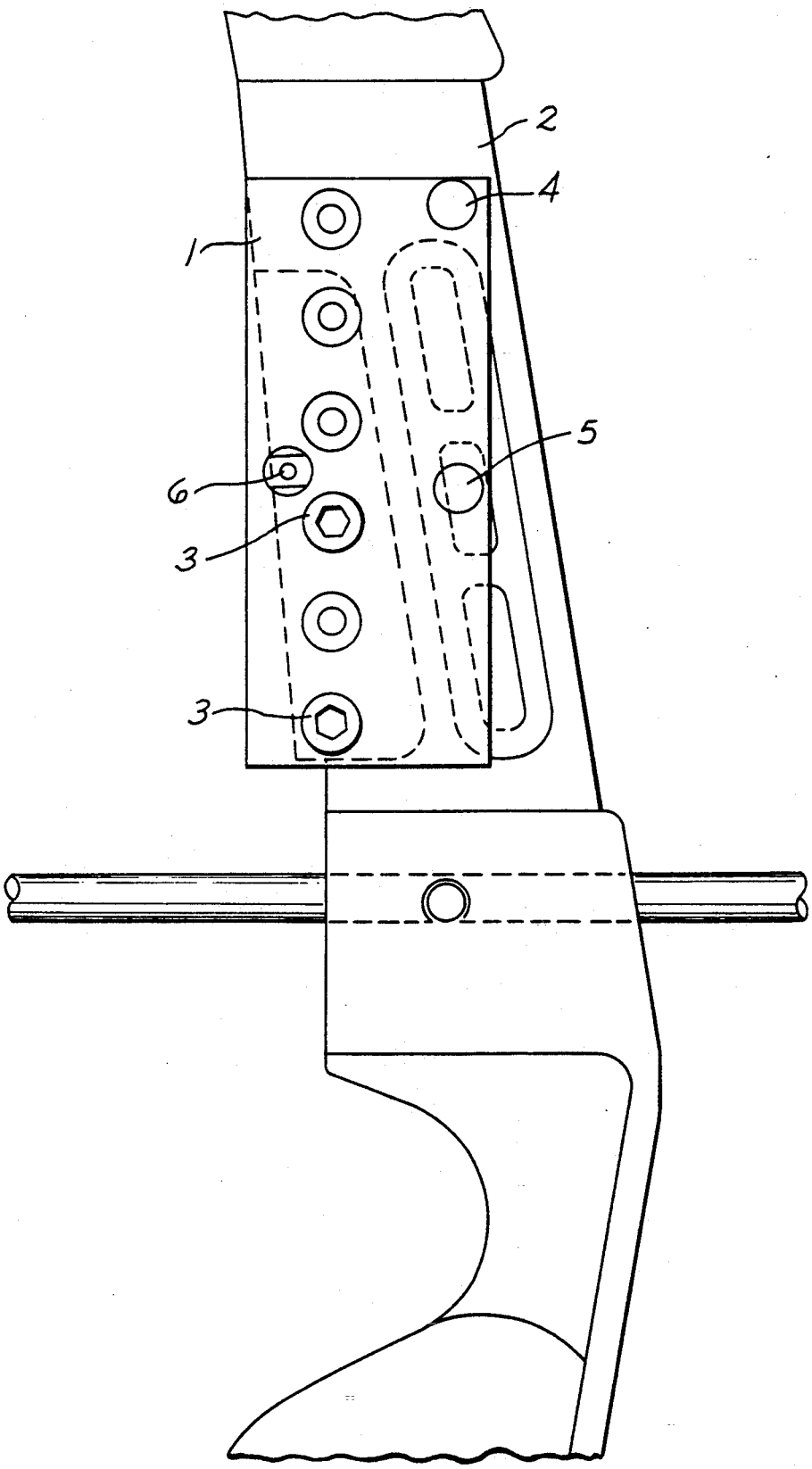
Figure 4:
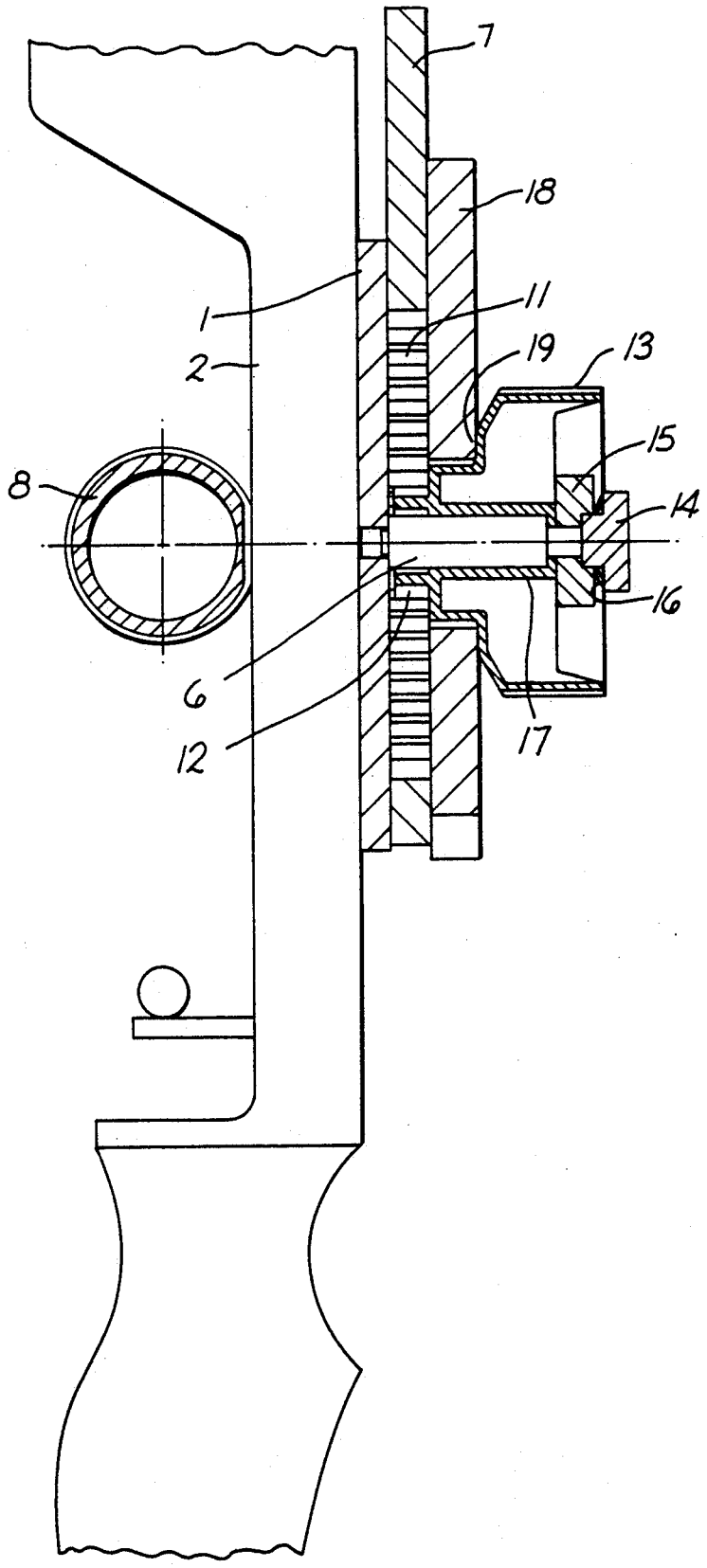
FIG. 4 is a section along the line IV—IV of FIG. 3.

As shown in the drawings—referring first to FIGS. 1 and 4—a mounting plate 1 is rigidly secured to a bow 2 by fastening means 3. The mounting plate 1 is of uniform thickness and carries three rigidly secured studs 4, 5 and 6 extending from the side of the mounting plate 1 which is remote from the bow 2. Said three studs 4, 5 and 6 form a triangle on the plate 1.

Figure 2:
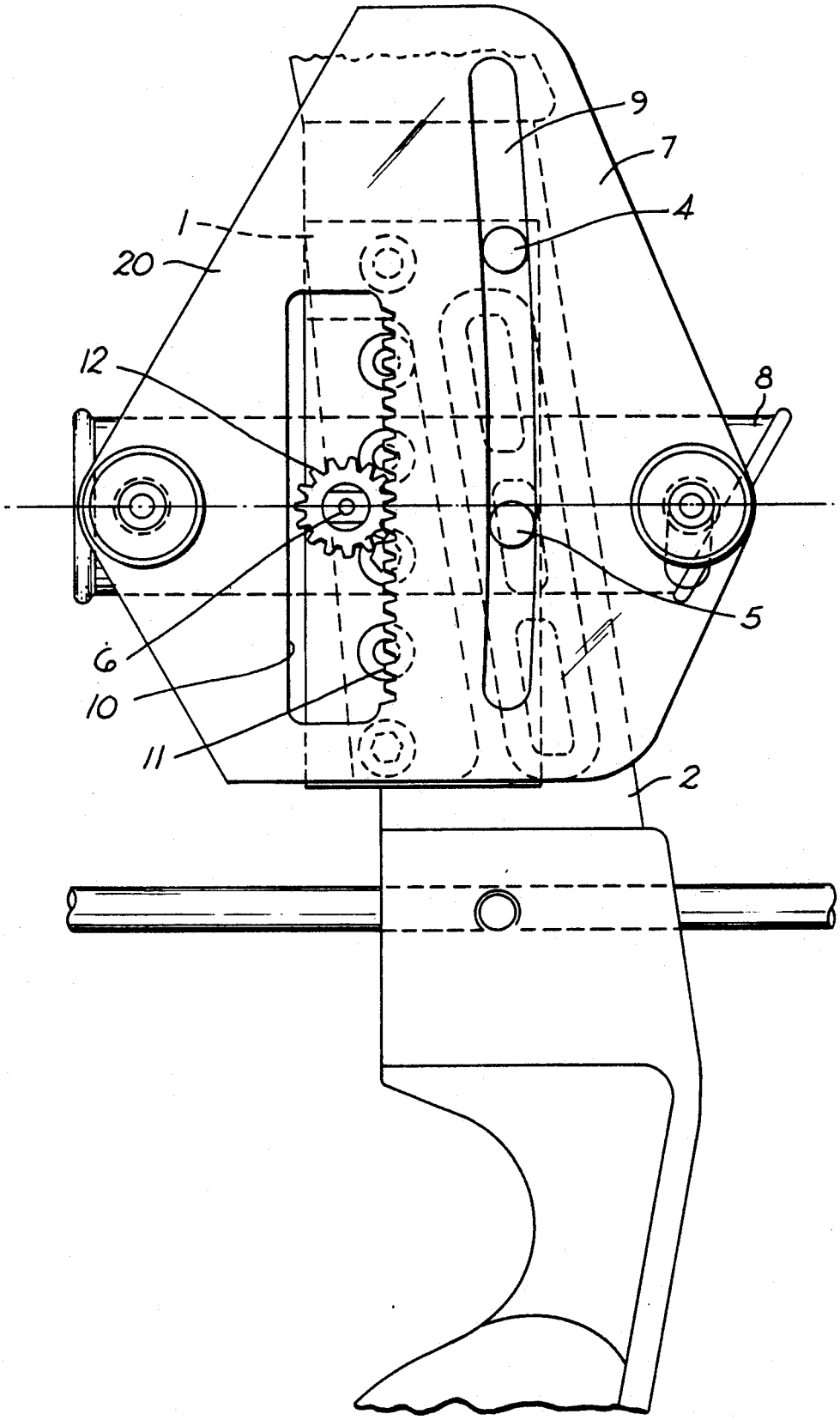
FIG. 2 is a side view of the mounting plate shown in FIG. 1 on which a sight carrying plate has been mounted.

As shown in FIGS. 2 and 4 a sight carrying plate 7 has been placed upon the mounting plate 1 in slidable relation thereto. The sight carrying plate 7 carries a telescope 8 or equivalent sight means. The sight carrying plate is provided with a slot 9 the width of which corresponds to the equal diameters of the two studs 4 and 5—said studs being passed through the slot 9. The sight carrying plate 7 has also a recess 10 limited by a tooth rack 11. The tooth rack 11 is engaged by a toothed wheel 12 mounted rotatably on the stud 6. The slot 9 and the tooth rack 11 are arcuately shaped and they have a common center. The radius of the arc formed by the slot 9 should correspond to the distance between the eye of the archer and the sight means 8. Said radius will be between 0.5 and 1 meter—preferably 0.7 meter—corresponding to an arms length. As will be understood from FIG. 2 a rotation of the wheel 12 will cause a displacement of the sight means 8 relative the mounting plate 1.

Figure 3:
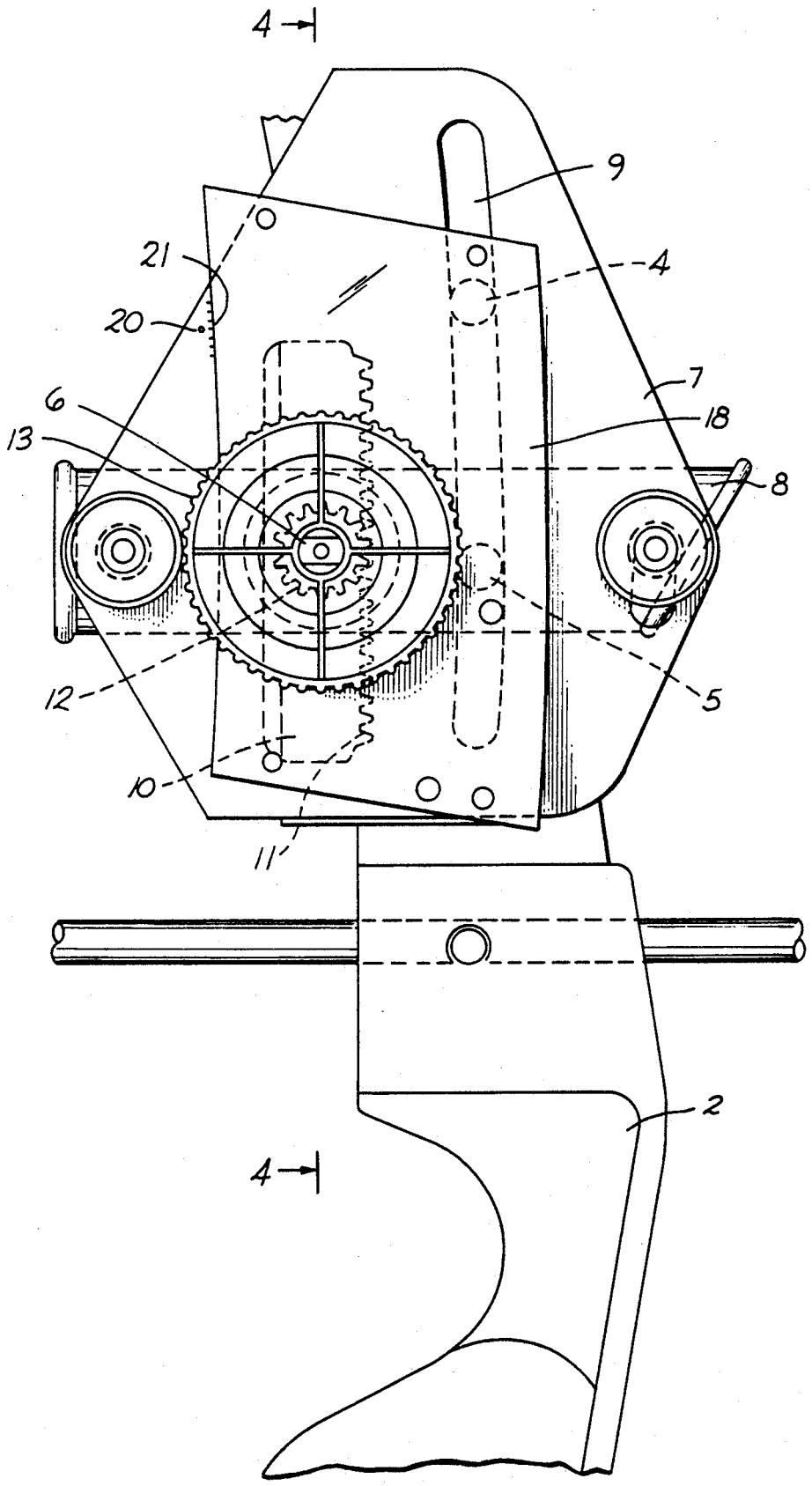
FIG. 3 is a side view of the parts shown in FIG. 2 on which a friction plate has been mounted.

The toothed wheel 12 has an integral hand knob part 13 of greater diameter—shown in FIGS. 3 and 4. As shown in FIG. 4 said wheel 12 and part 13 are engaged by a friction adjustment wheel 14 threaded on the stud 6 secured to the mounting plate 1.

A spacer 15 and a spring washer 16 are clamped between a hub 17 on the wheel 12 and the friction adjustment wheel 14.

The studs 4, 5 and 6 are also passed through corresponding holes in a friction plate 18 mounted outside the sight carrying plate 7. If the friction adjustment wheel 14 is threaded inwardly on the stud 6, a compression force will be transmitted (and increased) via a shoulder surface 19 on the part 13, the friction plate 18, the sight carrying plate 7 and the mounting plate 1. The spacer 15 is made of a low friction material, and thus the torque transmitted from the friction adjustment wheel 14 to the hand knob part 13 during turning of the friction adjustment wheel 14 in order to alter the friction between the sight carrying plate 7 and the two adjacent plates 1 and 18 will be insuffient for causing any unintended rotation of the hand knob part 13.

As shown in FIG. 3 the sight carrying plate 7 is provided with a pointer 20 and the friction plate 18 is provided with a scale 21 making it possible to read the relative positions of said plates.

The device described and shown in the drawings will operate as follows:

Referring preferably to FIGS. 3 and 4 showing the complete device according to the invention, the friction adjustment wheel 14 should be loosened prior to making an adjustment. A manual activation of the hand knob part 13 will cause a turning of the wheel 12 which in turn will cause an almost vertical displacement of the tooth rack 11. The slot 9 (FIG. 2) and the studs 4 and 5 will ensure that the movement of the sight carrying plate 7 will follow a part of an imaginary circle having its center near the eye of the archer holding the bow ready for shooting. After having displaced the sight carrying plate 7 relative the mounting plate 1—the displacement being readable on the scale 21—the friction adjustment wheel 14 is tightened so as to increase the friction between the sight carrying plate 7 and the adjacent two plates 1 and 18.

The sight means 8 will be connected to the sight carrying plate 7 by means—not shown and not making any part of the invention—allowing adjustments relative thereto in any direction.

I claim:

1. A sighting device for use on bows comprising a mounting plate adapted to be rigidly connected to a bow, a friction plate located parallel to said mounting plate and spaced therefrom, and a sight carrying plate sandwiched between said mounting plate and said friction plate characterised in:

that said mounting plate is provided with three studs extending from one side thereof and forming a triangle thereon;

that said sight carrying plate is provided with an arcuate slot adapted to receive two of said studs and having a radius between 0.5 and 1 meter to place an arc center near the eye of an archer holding the bow ready for shooting;

that said sight carrying plate has an arcuate tooth rack at a distance from said arcuate slot and having the same arc center as said slot;

and that the third one of said three studs carries a toothed wheel of such size and shape as to engage said toothed rack whereby rotation of the wheel disposes the sight carrying plate in an arcuate fashion about the arc center.

2. A sighting device as claimed in claim 1, characterised in that said radius of said slot is about 0.7 meter.

3. A sighting device as claimed in claim 1, characterised in that said third stud carries a threaded friction adjustment wheel for engaging said friction plate.

4. A sighting device as claimed in claim 1, characterised in that said sight carrying plate and said friction plate are provided with indicating marks for reading the relative displacement of said plates.

* * * * *